US011904385B2

(12) United States Patent
Tsuji et al.

(10) Patent No.: US 11,904,385 B2
(45) Date of Patent: Feb. 20, 2024

(54) DIE CASTING MACHINE

(71) Applicant: SHIBAURA MACHINE CO., LTD., Tokyo (JP)

(72) Inventors: Makoto Tsuji, Zama (JP); Yuto Hayashi, Zama (JP); Saburo Noda, Zama (JP)

(73) Assignee: SHIBAURA MACHINE CO., LTD., Tokyo (JP)

( * ) Notice: Subject to any disclaimer, the term of this patent is extended or adjusted under 35 U.S.C. 154(b) by 0 days.

(21) Appl. No.: 17/454,388

(22) Filed: Nov. 10, 2021

(65) Prior Publication Data

US 2022/0062977 A1 Mar. 3, 2022

Related U.S. Application Data

(63) Continuation of application No. PCT/JP2020/018374, filed on May 1, 2020.

(30) Foreign Application Priority Data

May 17, 2019 (JP) ..... 2019-094041

(51) Int. Cl.

| | |
|---|---|
| ***B22D 17/10*** | (2006.01) |
| ***B22D 17/14*** | (2006.01) |
| ***B22D 17/20*** | (2006.01) |
| ***B22D 17/28*** | (2006.01) |
| ***B22D 17/30*** | (2006.01) |

(Continued)

(52) U.S. Cl.

CPC ..... *B22D 17/10* (2013.01); *B22D 17/145* (2013.01); *B22D 17/203* (2013.01); *B22D 17/2023* (2013.01); *B22D 17/28* (2013.01); *B22D 17/30* (2013.01); *B22D 17/32* (2013.01); *B22D 39/006* (2013.01)

(58) Field of Classification Search

CPC ..... B22D 17/10; B22D 17/14; B22D 17/145; B22D 17/20; B22D 17/2023; B22D 17/203; B22D 17/28; B22D 17/30; B22D 17/32; B22D 39/00; B22D 39/006

USPC ..... 164/303, 312, 113

See application file for complete search history.

(56) References Cited

U.S. PATENT DOCUMENTS 4,476,911 A 10/1984 Lossack

FOREIGN PATENT DOCUMENTS

| | | |
|---|---|---|
| JP | S57-152361 | 9/1982 |
| JP | S63-85365 | 6/1988 |
| JP | H01-271050 | 10/1989 |

(Continued)

OTHER PUBLICATIONS

Japanese Office Action in Application No. 2019-094041, dated Dec. 6, 2022.

(Continued)

*Primary Examiner* — Kevin P Kerns

(74) *Attorney, Agent, or Firm* — DLA Piper LLP (US)

(57) ABSTRACT

A die casting machine of an embodiment includes: a holding furnace holding molten metal; a sleeve located outside the holding furnace and having a molten metal supply port passing through a mold; a plunger sliding through the sleeve and including a plunger rod and a plunger tip fixed to a tip of the plunger rod; a molten metal supply pipe supplying the molten metal into the sleeve and attachable to and detachable from the molten metal supply port; and a moving mechanism detaching the molten metal supply port when the plunger is sliding.

14 Claims, 10 Drawing Sheets

(51) Int. Cl.

| | |
|---|---|
| ***B22D 17/32*** | (2006.01) |
| ***B22D 39/00*** | (2006.01) |

(56) References Cited

FOREIGN PATENT DOCUMENTS

| | | |
|---|---|---|
| JP | H04-258357 | 9/1992 |
| JP | H05-104227 | 4/1993 |
| JP | H06-99262 | 4/1994 |
| JP | H06-154985 | 6/1994 |
| JP | H07-155924 | 6/1995 |
| JP | H09-136153 | 5/1997 |
| JP | 2002-239708 | 8/2002 |
| JP | 2003-145261 | 5/2003 |
| JP | 2003-225748 | 8/2003 |
| JP | 2006-116598 | 5/2006 |
| JP | 2007-313554 | 12/2007 |
| JP | 2010-058129 | 3/2010 |
| JP | 2012-223778 | 11/2012 |
| JP | 2012-232338 | 11/2012 |
| JP | 2013-066896 | 4/2013 |
| JP | 2016-022510 | 2/2016 |
| JP | 2016-032835 | 3/2016 |

OTHER PUBLICATIONS

Japanese Office Action in Application No. 2019-094042, dated Dec. 6, 2022.
Chiense Office Action in Application No. 202080034832.9, dated Nov. 18, 2022.
International Search Report dated Jul. 14, 2020 issued International Application No. PCT/JP2020/018374.
Written Opinion dated Jul. 14, 2020 issued International Application No. PCT/JP2020/018374.
International Search Report dated Jul. 14, 2020 issued International Application No. PCT/JP2020/018375.
Written Opinion dated Jul. 14, 2020 issued International Application No. PCT/JP2020/018375.
English Language Abstract of JP 2010-058129 published Mar. 18, 2010.
U.S. Appl. No. 17/454,390, filed Nov. 10, 2021.
Chinese Office Action in Application No. 202080031722.7, dated Sep. 5, 2022.
India Office Action in Application 202117053158, dated Apr. 12, 2022.
India Office Action in Application 202117053160, dated Apr. 26, 2022.
U.S. Appl. No. 17/454,390, filed Nov. 10, 2021 electronically captured on May 17, 2023.
U.S. Appl. No. 17/454,390, filed Nov. 10, 2021 electronically captured on Sep. 11, 2023.
File Wrapper History of U.S. Appl. No. 17/454,390, filed Nov. 10, 2021 electronically captured on Jan. 10, 2024.

DIE CASTING MACHINE

CROSS-REFERENCE TO RELATED APPLICATION

This application is continuation application of, and claims the benefit of priority from the International Application PCT/JP2020/18374, filed May 1, 2020, which claims the benefit of priority from Japanese Patent Application No. 2019-094041, filed on May 17, 2019, the entire contents of all of which are incorporated herein by reference.

FIELD OF THE INVENTION

The present invention relates to a die casting machine and particularly to a semi-hot chamber type die casting machine.

BACKGROUND OF THE INVENTION

In a so-called semi-hot chamber type die casting machine, a sleeve connected to an inside of a mold and a plunger extruding molten metal in the sleeve into the mold are provided outside a holding furnace storing molten metal similarly to a cold chamber type die casting machine. However, in the semi-hot chamber type, the holding furnace and the sleeve connected to each other and molten metal is supplied to the sleeve via a molten metal supply pipe connected to the sleeve instead of pumping the molten metal in the holding furnace by the ladle and pouring the molten metal into the sleeve unlike the cold chamber type.

In the semi-hot chamber type die casting machine, there is concern that an impact is applied to a connection portion between the sleeve and the molten metal supply pipe during the injection of the plunger so that the molten metal supply pipe may be broken. Thus, it is desired to reduce the impact applied to the molten metal supply pipe during the injection of the plunger and suppress the breakage of the molten metal supply pipe.

SUMMARY OF THE INVENTION

A die casting machine according to an aspect of the invention includes: a holding furnace holding molten metal; a sleeve located outside the holding furnace, the sleeve connected to an inside of a mold, and the sleeve having a molten metal supply port; a plunger sliding through the sleeve and including a plunger rod and a plunger tip fixed to a tip of the plunger rod; a molten metal supply pipe supplying the molten metal into the sleeve and, the molten metal supply pipe being attachable to and detachable from the molten metal supply port; and a moving mechanism configured to detach the molten metal supply pipe from the molten metal supply port when the plunger is sliding.

The die casting machine of the above-described aspect may further include a detachment control circuit configured to control the moving mechanism so that the molten metal supply pipe is detached from the molten metal supply port after the plunger tip blocks the molten metal supply port.

In the die casting machine of the above-described aspect, the molten metal supply port may be provided at a lower portion of the sleeve.

In the die casting machine of the above-described aspect, the molten metal supply pipe may be fixed to the holding furnace and the moving mechanism may move the holding furnace.

In the die casting machine of the above-described aspect, the molten metal supply pipe may be movable relative to the holding furnace and the moving mechanism may move the molten metal supply pipe independently from the holding furnace.

In the die casting machine of the above-described aspect, the molten metal supply pipe may have a cylindrical shape extending in a linear shape.

In the die casting machine of the above-described aspect, the molten metal supply pipe may be made of ceramics.

The die casting machine of the above-described aspect may further include a molten metal supply drive device configured to generate a driving force for transferring the molten metal from the holding furnace to the sleeve via the molten metal supply pipe.

In the die casting machine of the above-described aspect, the molten metal supply drive device may be an electromagnetic pump.

In the die casting machine of the above-described aspect, the molten metal supply drive device may be a pneumatic device raising an air pressure in the holding furnace.

The die casting machine of the above-described aspect may further include a molten metal supply control circuit configured to control the molten metal supply drive device so that a filling rate of the molten metal in the sleeve at a time point when the supply of the molten metal into the sleeve is completed becomes 70% or more.

In the die casting machine of the above-described aspect, the molten metal supply control circuit may control the molten metal supply drive device so that the filling rate of the molten metal in the sleeve when the plunger tip reaches a position of blocking the molten metal supply port becomes 95% or more.

The die casting machine of the above-described aspect may further include a first sensor facing a predetermined height between a lowermost portion and an uppermost portion of an inner surface of the sleeve and detecting that the molten metal in the sleeve reaches the predetermined height.

In the die casting machine of the above-described aspect, the sleeve may include a gas vent port provided at an upper portion, and the die casting machine may further include a second sensor provided above the gas vent port and detecting a molten metal surface position of the molten metal in the sleeve.

The die casting machine of the above-described aspect may further include an injection drive device configured to drive the plunger and an injection control circuit configured to control the injection drive device so that an injection speed of the plunger increases after the plunger tip reaches a position of blocking the molten metal supply port.

In the die casting machine of the above-described aspect, a distance between the molten metal supply port and the molten metal supply pipe after the molten metal supply pipe is detached from the molten metal supply port may be 1 mm or more and 10 mm or less.

DETAILED DESCRIPTION OF THE EMBODIMENTS

Hereinafter, embodiments of the invention will be described with reference to the drawings.

First Embodiment

A die casting machine of a first embodiment includes: a holding furnace holding molten metal; a sleeve located outside the holding furnace, the sleeve connected to an inside of a mold, and the sleeve having a molten metal supply port; a plunger sliding through the sleeve and including a plunger rod and a plunger tip fixed to a tip of the plunger rod; a molten metal supply pipe supplying the molten metal into the sleeve and, the molten metal supply pipe being attachable to and detachable from the molten metal supply port; and a moving mechanism configured to detach the molten metal supply pipe from the molten metal supply port when the plunger is sliding.

Figure 1:
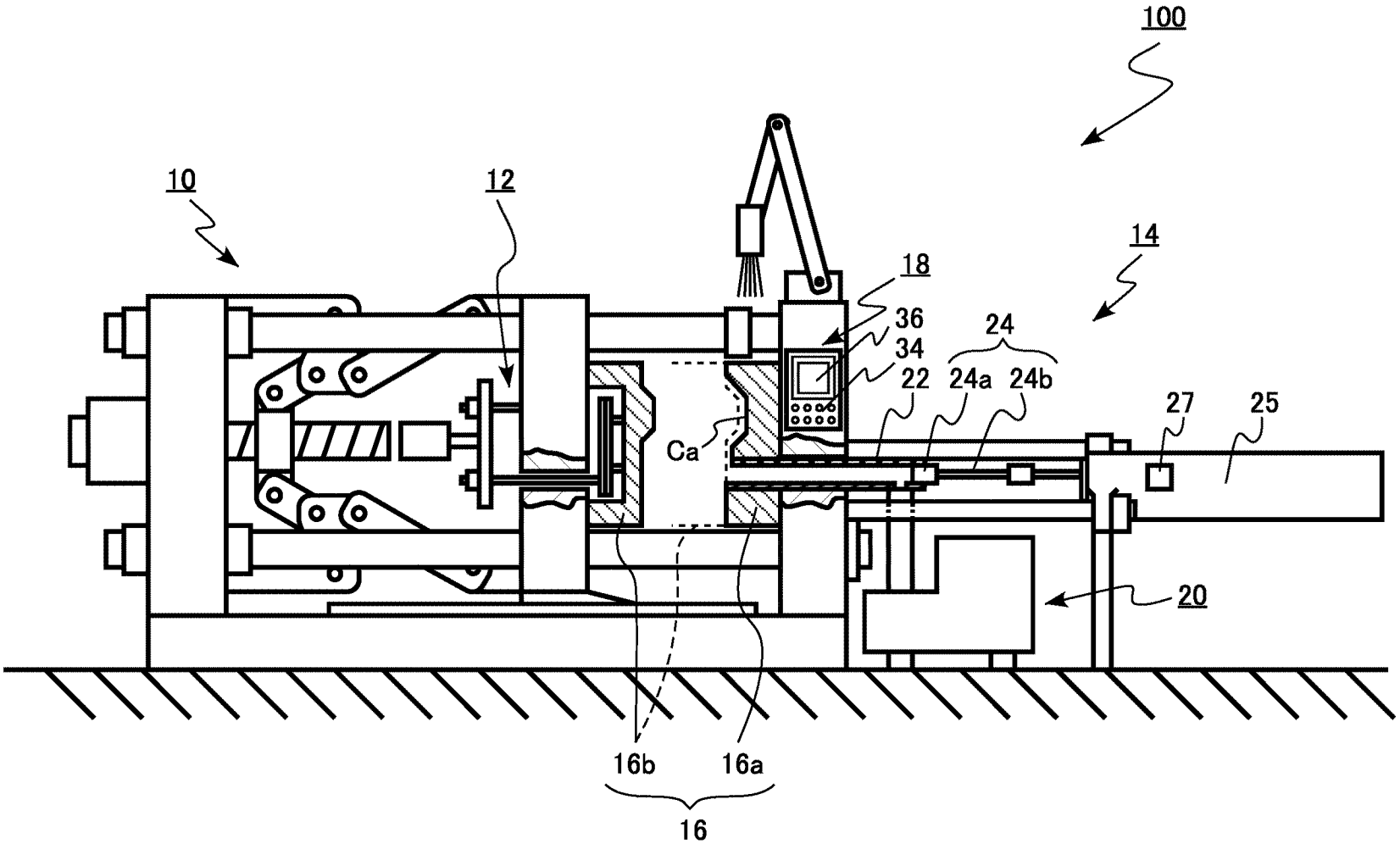
FIG. 1 is a schematic view showing an overall configuration of a die casting machine of a first embodiment.
Figure 2:
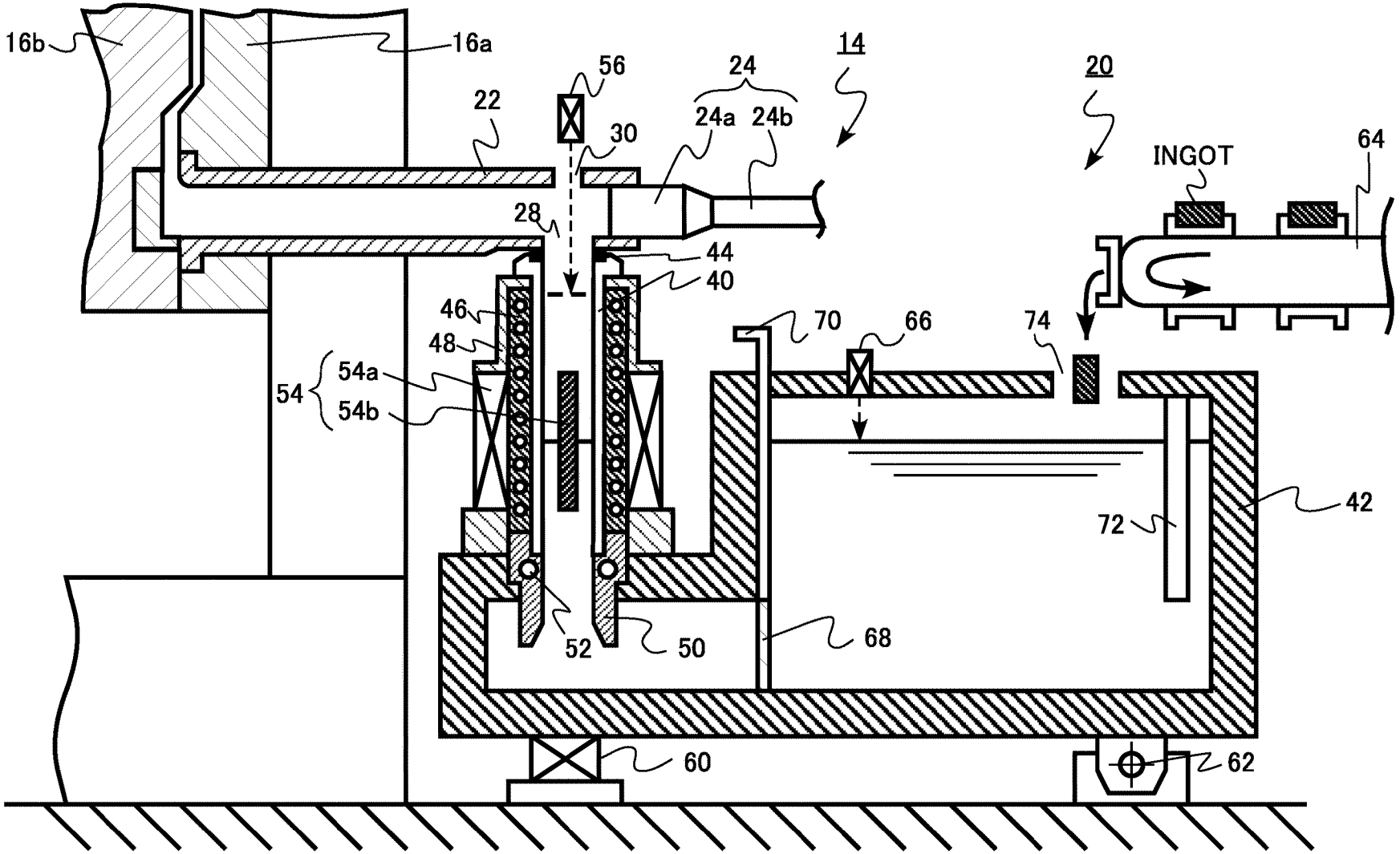
FIG. 2 is a schematic cross-sectional view showing a sleeve, a plunger, and a molten metal supply device of the die casting machine of the first embodiment.

FIG. 1 is a schematic view showing an overall configuration of the die casting machine of the first embodiment. FIG. 1 is a side view including a partially cross-sectional view. FIG. 2 is a schematic cross-sectional view showing the sleeve, the plunger, and the molten metal supply device of the die casting machine of the first embodiment.

Figure 3:
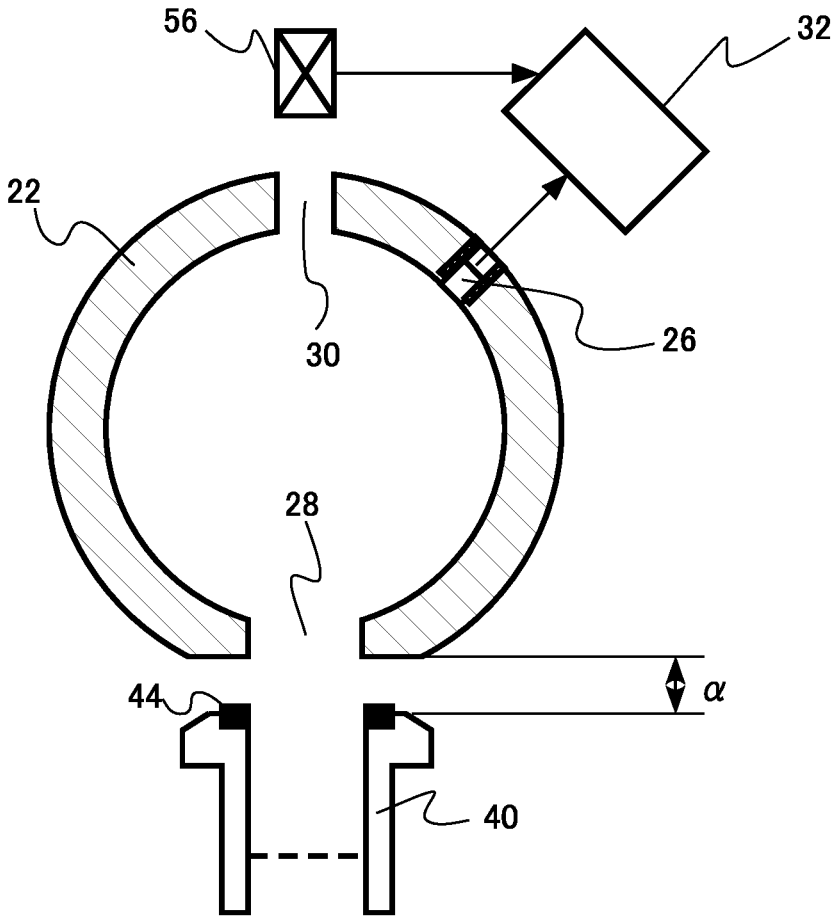
FIG. 3 is a schematic cross-sectional view of a sleeve and a molten metal supply pipe of the die casting machine of the first embodiment.

FIG. 3 is a schematic cross-sectional view of the sleeve and the molten metal supply pipe of the die casting machine of the first embodiment. FIG. 3 is a cross-sectional view perpendicular to the extension direction of the sleeve. Additionally, the up and down direction of the paper is the vertical direction and the left and right direction of the paper and the penetration direction of the paper are the horizontal directions.

Figure 4:
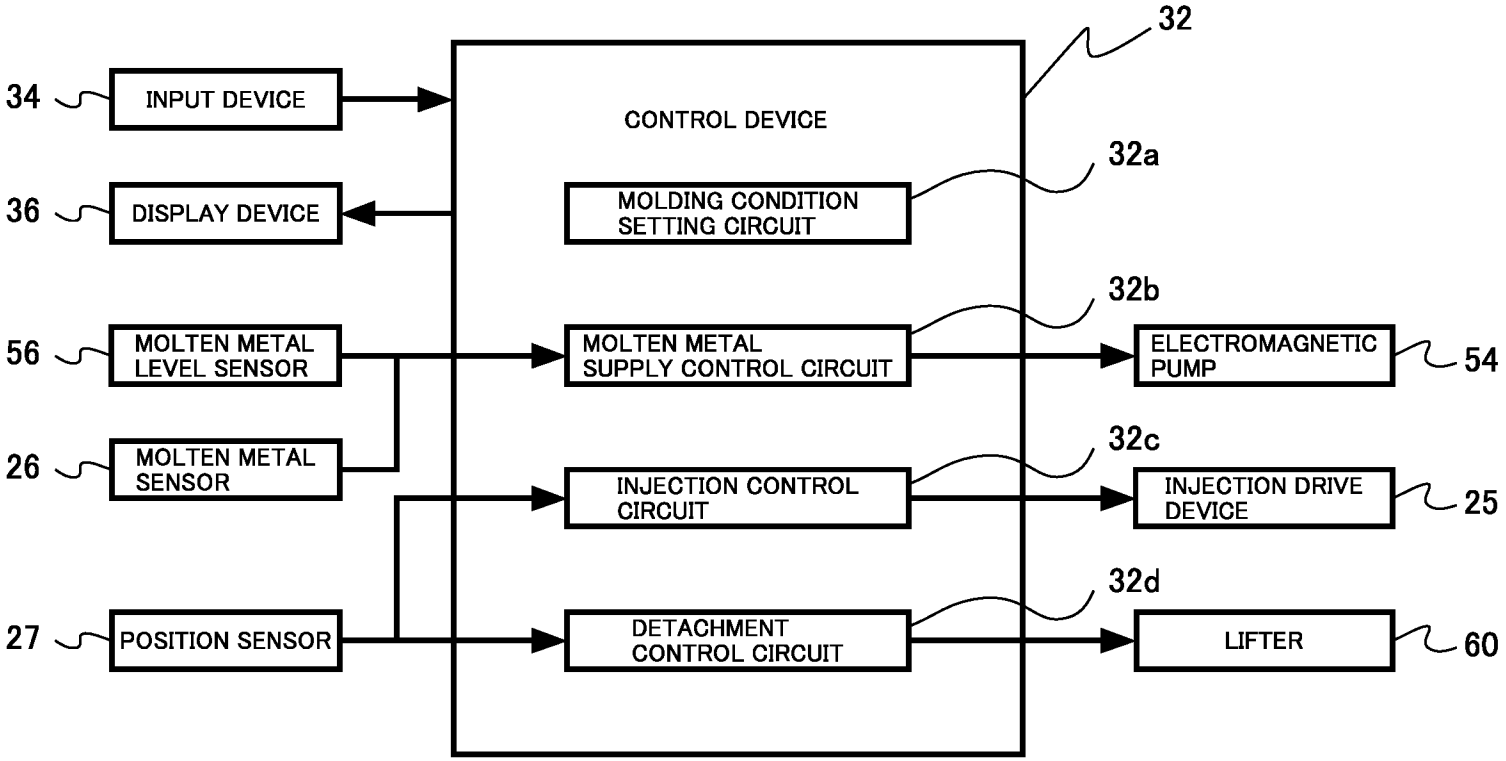
FIG. 4 is a block diagram showing a configuration of a signal processing system of the die casting machine of the first embodiment.

FIG. 4 is a block diagram showing a configuration of a signal processing system of the die casting machine of the first embodiment.

A die casting machine 100 of the first embodiment is a semi-hot chamber type die casting machine.

The die casting machine 100 includes a mold clamping device 10, an extrusion device 12, an injection device 14, a mold 16, a control system 18, and a molten metal supply device 20.

The injection device 14 includes a sleeve 22, a plunger 24, an injection drive device 25, and a position sensor 27. The plunger 24 includes a plunger tip 24*a* and a plunger rod 24*b*. The sleeve 22 is provided with a molten metal sensor 26 (first sensor), a molten metal supply port 28, and a gas vent port 30.

The mold 16 includes a fixed die 16*a* and a movable die 16*b*.

The control system 18 includes a control device 32, an input device 34, and a display device 36. The control device 32 includes a molding condition setting circuit 32*a*, a molten metal supply control circuit 32*b*, an injection control circuit 32*c*, and a detachment control circuit 32*d*.

The molten metal supply device 20 includes a molten metal supply pipe 40, a holding furnace 42, a packing 44, a first heater 46, a guard member 48, a molten metal supply pipe sleeve 50, a second heater 52, an electromagnetic pump (molten metal supply drive device), a molten metal level sensor 56 (second sensor), a lifter 60 (moving mechanism), a fulcrum 62, and a metal feeder 64. The holding furnace 42 is provided with a holding furnace molten metal level sensor 66, a filter 68, a filter support 70, a holding furnace heater 72, and a metal supply port 74. The electromagnetic pump 54 includes a coil 54*a* and a core 54*b*.

The die casting machine 100 is a machine that manufactures a die casting product by injecting a liquid metal (molten metal) into the mold 16 (cavity Ca in FIG. 1) and solidifying the liquid metal in the mold 16. The metal is, for example, aluminum, an aluminum alloy, a zinc alloy, or a magnesium alloy.

The mold 16 is provided between the mold clamping device 10 and the injection device 14. The mold 16 includes the fixed die 16*a* and the movable die 16*b*.

The mold clamping device 10 has a function of opening and closing the mold 16 and clamping the mold.

The injection device 14 has a function of injecting a liquid metal into the mold 16. The injection device 14 includes, as shown in FIG. 1, the sleeve 22, the plunger 24, the injection drive device 25, and the position sensor 27.

The sleeve 22 is located outside the holding furnace 42 that holds the molten metal. The sleeve 22 passes through the mold 16. The sleeve 22 is, for example, a tubular member connected to the fixed die 16*a*. The sleeve 22 has, for example, a cylindrical shape.

The plunger 24 slides through the sleeve 22. The plunger tip 24*a* fixed to the tip of the plunger rod 24*b* slides through the sleeve 22 in the front and rear direction. Since the plunger tip 24*a* slides forward through the sleeve 22, the molten metal in the sleeve 22 is extruded into the mold 16.

The injection drive device 25 has a function of driving the plunger 24 in the front and rear direction. The injection drive device 25 is, for example, a hydraulic type, an electric type, or a hybrid type in which a hydraulic type and an electric type are combined.

The position sensor 27 has a function of detecting the position of the plunger 24. The position sensor 27 is, for example, an optical or magnetic linear encoder. It is possible to detect the speed of the plunger 24 by differentiating the position of the plunger 24 detected by the position sensor 27.

As shown in FIG. 3, the sleeve 22 is provided with the molten metal sensor 26 (first sensor), the molten metal supply port 28, and the gas vent port 30.

The molten metal supply port 28 is provided at the lower portion of the sleeve 22. The molten metal is supplied from the molten metal supply pipe 40 connected to the molten metal supply port 28 into the sleeve 22.

The gas vent port 30 is provided at the upper portion of the sleeve 22. The gas vent port 30 has a function of exhausting the gas in the upper portion of the sleeve 22 when the sleeve 22 is filled with the molten metal. The filling time of the molten metal in the sleeve 22 is shortened by providing the gas vent port 30.

The molten metal sensor 26 faces a predetermined height between the lowermost portion and the uppermost portion of the inner surface of the sleeve 22. The molten metal sensor 26 is exposed into, for example, the sleeve 22.

The molten metal sensor 26 detects that the molten metal reaches the position of the molten metal sensor 26 in the sleeve 22.

The molten metal sensor 26 is, for example, a resistance sensor having a pair of electrodes and outputting a signal by energizing when the molten metal reaches the position of the electrodes. Further, the molten metal sensor 26 is, for example, a temperature sensor that outputs a signal when the temperature exceeds a predetermined value. Further, the molten metal sensor 26 is, for example, a pressure sensor that outputs a signal when the pressure exceeds a predetermined value.

The molten metal supply device 20 is provided below the sleeve 22. The molten metal supply device 20 has a function of supplying the molten metal into the sleeve 22 and filling the sleeve 22 with the molten metal.

The molten metal supply device 20 includes, as shown in FIG. 2, the molten metal supply pipe 40, the holding furnace 42, the packing 44, the first heater 46, the guard member 48, the molten metal supply pipe sleeve 50, the second heater 52, the electromagnetic pump 54 (molten metal supply drive device), the molten metal level sensor 56 (second sensor), the lifter 60 (moving mechanism), the fulcrum 62, and the metal feeder 64.

The molten metal supply pipe 40 is provided below the sleeve 22. The molten metal supply pipe 40 is attachable to and detachable from the molten metal supply port 28 of the sleeve 22. The molten metal supply pipe 40 is fixed to, for example, the holding furnace 42. The molten metal supply pipe 40 has a function of supplying the molten metal into the sleeve 22.

The molten metal supply pipe 40 is a tubular member. The molten metal supply pipe 40 has, for example, a cylindrical shape extending in a linear shape in the vertical direction. For example, the diameter of the cylinder may change in the vertical direction. The molten metal supply pipe 40 does not include, for example, a bent portion.

The molten metal supply pipe 40 is made of, for example, ceramics. The molten metal supply pipe 40 is made of, for example, only ceramics.

A distance (a in FIG. 3) between the molten metal supply port 28 and the molten metal supply pipe 40 after the molten metal supply pipe 40 is detached from the molten metal supply port 28 is, for example, 1 mm or more and 10 mm or less.

The packing 44 is provided at the upper end of the molten metal supply pipe 40. The packing 44 has a function of preventing the molten metal from leaking from a gap of the contact portion between the sleeve 22 and the molten metal supply pipe 40. The packing 44 has heat resistance.

The first heater 46 is provided around the molten metal supply pipe 40. The first heater 46 has a function of heating the molten metal in the molten metal supply pipe 40.

The guard member 48 covers the upper end portion and the upper portion side surface of the first heater 46. The guard member 48 has a function of protecting the first heater 46.

The molten metal supply pipe sleeve 50 is provided below the molten metal supply pipe 40. The lower end of the molten metal supply pipe 40 is inserted into, for example, the molten metal supply pipe sleeve 50. The lower end of the molten metal supply pipe sleeve 50 is immersed into the molten metal of the holding furnace 42. The molten metal supply pipe sleeve 50 is made of, for example, ceramics.

The second heater 52 is provided in the molten metal supply pipe sleeve 50. The second heater 52 has a function of heating the molten metal in the molten metal supply pipe sleeve 50.

The electromagnetic pump 54 is an example of the molten metal supply drive device. The electromagnetic pump 54 includes the coil 54*a* and the core 54*b*. The coil 54*a* is provided around the molten metal supply pipe 40 and the core 54*b* is provided in the molten metal supply pipe 40.

The electromagnetic pump 54 generates a driving force for transferring the molten metal from the holding furnace 42 to the sleeve 22 via the molten metal supply pipe 40.

As shown in FIG. 3, the molten metal level sensor 56 is provided above the gas vent port 30 provided in the sleeve 22. The molten metal level sensor 56 has a function of detecting the molten metal surface position in the sleeve 22.

The molten metal level sensor 56 is, for example, a non-contact type sensor that detects the height of the molten metal surface from above the molten metal surface. The molten metal level sensor 56 is, for example, an optical or ultrasonic sensor.

The holding furnace 42 is provided below the sleeve 22. The holding furnace 42 has a function of holding the molten metal therein.

The holding furnace 42 is provided with the holding furnace molten metal level sensor 66, the filter 68, the filter support 70, the holding furnace heater 72, and the metal supply port 74.

The holding furnace molten metal level sensor 66 has a function of detecting the position of the molten metal surface in the holding furnace 42. The holding furnace molten metal level sensor 66 is, for example, a non-contact type sensor that detects the height of the molten metal surface from above the molten metal surface. The holding furnace molten metal level sensor 66 is, for example, an optical or ultrasonic sensor.

For example, the height of the molten metal surface in the holding furnace 42 is maintained at a predetermined position by supplying an ingot into the holding furnace 42 based on the height of the molten metal surface detected by the holding furnace molten metal level sensor 66. For example, the molten metal surface in the molten metal supply pipe 40 is brought into contact with the core 54*b* of the electromagnetic pump 54 by maintaining the height of the molten metal surface in the holding furnace 42 at a predetermined position.

The filter 68 is provided in the holding furnace 42. The filter 68 suppresses the supply of solid matter such as oxides of the molten metal contained in the molten metal into the sleeve 22.

The filter support 70 is fixed to the filter 68. The filter support 70 has a function of pulling the filter 68 out of the holding furnace 42.

The holding furnace heater 72 is immersed in the molten metal in the holding furnace 42. The holding furnace heater 72 has a function of heating the molten metal in the holding furnace 42.

The metal supply port 74 is provided on the upper surface of the holding furnace 42. For example, an ingot that is a raw material for molten metal is input from the metal supply port 74. The molten metal may be supplied from the metal supply port 74.

The lifter 60 is provided below the holding furnace 42. The lifter 60 is an example of the moving mechanism. The lifter 60 has a function of attaching and detaching the molten metal supply pipe 40 fixed to the holding furnace 42 to and from the molten metal supply port 28 by moving the holding furnace 42 in the up and down direction. The lifter 60 has a function of detaching the molten metal supply pipe 40 from the molten metal supply port 28 when the plunger 24 is sliding.

The lifter 60 is, for example, an electric jack or a hydraulic jack.

The fulcrum 62 is provided below the holding furnace 42. The holding furnace 42 moves in the up and down direction by using the fulcrum 62 as a shaft by operating the lifter 60.

The metal feeder 64 is provided above the holding furnace 42. The metal feeder 64 supplies, for example, an ingot as a raw material for molten metal into the holding furnace 42 from the metal supply port 74. The metal feeder 64 may supply the molten metal from, for example, the metal supply port 74.

The control system 18 includes the control device 32, the input device 34, and the display device 36.

The input device 34 is provided on, for example, a fixed die plate (reference numeral omitted) of the mold clamping device 10. The input device 34 receives an operator's input operation. The operator can set the molding conditions and the like of the die casting machine 100 by using the input device 34.

The input device 34 is, for example, a touch panel using a liquid crystal display or an organic EL display.

The display device 36 is provided on, for example, the fixed die plate (reference numeral omitted) of the mold clamping device 10. The display device 36 displays, for example, the molding conditions, the operation status, and the like of the die casting machine 100 on the screen. The display device 36 is, for example, a liquid crystal display or an organic EL display.

The control device 32 has a function of controlling the molding operation of the die casting machine 100 using the mold clamping device 10, the extrusion device 12, the injection device 14, and the molten metal supply device 20. The control device 32 has a function of performing various calculations and outputting a control command to each part of the die casting machine 100.

The control device 32 has, for example, a combination of hardware and software. The control device 32 includes, for example, a CPU (Central Processing Unit), a semiconductor memory, and a control program stored in the semiconductor memory.

The control device 32 includes, as shown in FIG. 4, the molding condition setting circuit 32*a*, the molten metal supply control circuit 32*b*, the injection control circuit 32*c*, and the detachment control circuit 32*d*.

The molding condition setting circuit 32*a* has a function of setting various molding conditions such as the injection speed of the plunger 24 based on the signal from the input device 34.

The molten metal supply control circuit 32*b* has a function of controlling the supply of the molten metal from the holding furnace 42 into the sleeve 22 based on the data of the molten metal surface position detected by the molten metal sensor 26 and the molten metal level sensor 56. The supply of the molten metal into the sleeve 22 is performed by controlling the driving of the electromagnetic pump 54.

The molten metal supply control circuit 32*b* controls the electromagnetic pump 54, for example, so that the filling rate of the molten metal in the sleeve 22 at the time point when the supply of the molten metal to the sleeve 22 is completed is 70% or more. Further, the molten metal supply control circuit 32*b* controls the electromagnetic pump 54, for example, so that the filling rate of the molten metal in the sleeve 22 when the plunger tip 24*a* reaches a position of blocking the molten metal supply port 28 becomes 95% or more.

The injection control circuit 32*c* has a function of controlling the injection drive device 25 based on the position of the plunger 24 detected by the position sensor 27. For example, the injection control circuit 32*c* controls the injection drive device 25 so that the injection speed of the plunger 24 increases after the plunger tip 24*a* reaches a position of blocking the molten metal supply port 28.

The detachment control circuit 32*d* has a function of controlling the lifter 60 based on the position of the plunger 24 detected by the position sensor 27. For example, the detachment control circuit 32*d* controls the lifter 60 so that the molten metal supply pipe 40 is detached from the molten metal supply port 28 after the plunger tip 24*a* blocks the molten metal supply port 28.

Next, an example of the operation of the die casting machine 100 will be described.

Figure 5:
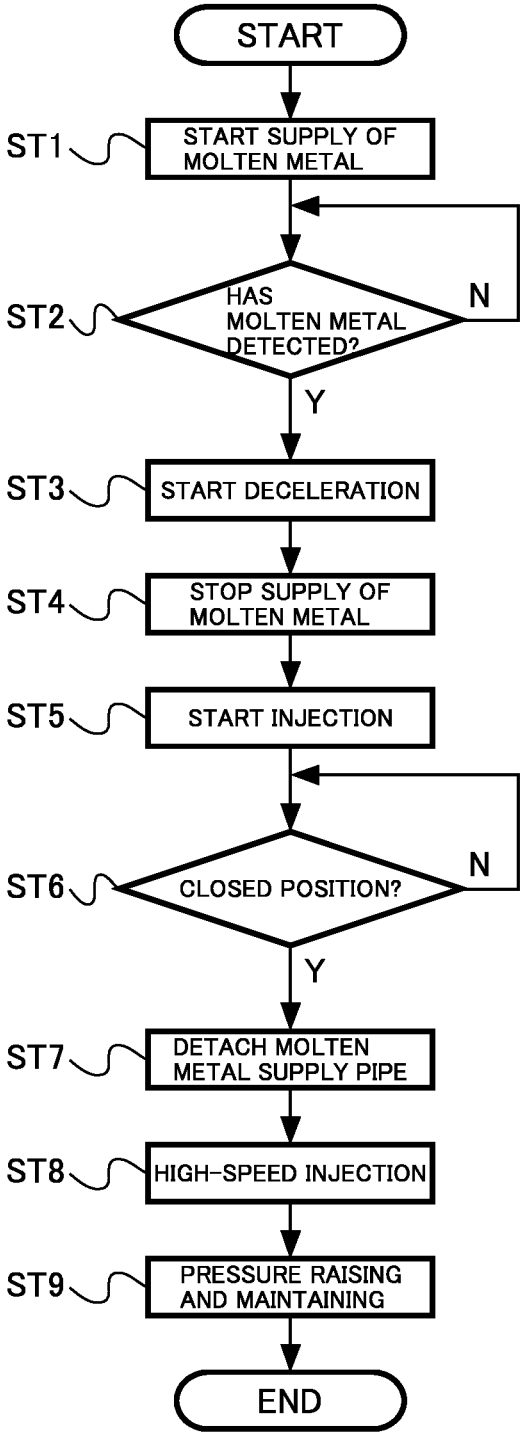
FIG. 5 is a flowchart of an example of an operation of the die casting machine of the first embodiment.

FIG. 5 is a flowchart of an example of the operation of the die casting machine of the first embodiment. FIG. 5 shows a period from the molten metal supply state into the sleeve 22 to the pressure raising and maintaining state after the high-speed injection. That is, the description of the mold closing and clamping operations before the molten metal supply state and the mold opening operation, the extrusion, and the like after the pressure raising and maintaining state will be omitted. The operation for which the description is omitted is, for example, the same as a known operation.

The operation of the die casting machine 100 includes a molten metal supply start step (Step ST1), a molten metal detection determination step (Step ST2), a deceleration start step (Step ST3), a molten metal supply stop step (Step ST4), an injection start step (Step ST5), a closed position determination step (Step ST6), a molten metal supply pipe detachment step (Step ST7), a high-speed injection step (Step ST8), and a pressure raising and maintaining step (Step ST9).

FIGS. 6, 7A, 7B, and 7C are explanatory diagrams of the operation of the die casting machine of the first embodiment.

Figure 6:
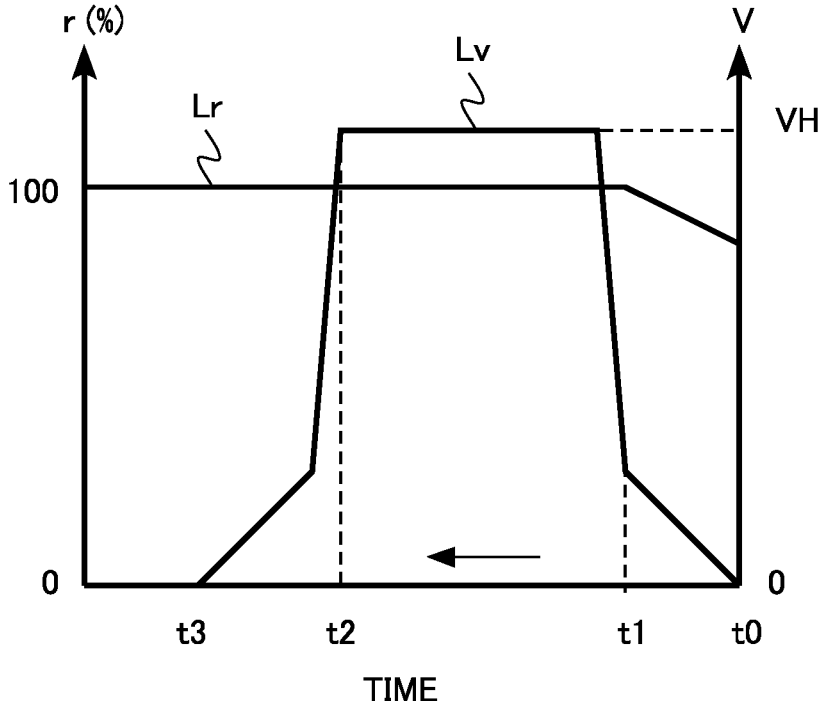
FIG. 6 is an explanatory diagram of an example of an operation of the die casting machine of the first embodiment.

FIG. 6 is a graph showing an example of an injection operation of the die casting machine 100. The horizontal axis indicates a time. As time goes by, the plotted points are on the left side of the paper. The vertical axis on the right side of the paper shows the injection speed, that is, the speed of the plunger 24. Further, the vertical axis on the left side of the paper shows the filling rate of the molten metal in the sleeve 22. The filling rate means the ratio of the molten metal to the volume of the sleeve 22 in front of the plunger 24. The line Lv indicates a change in the injection speed over time. Further, the line Lr indicates a change in the filling rate of the molten metal into the sleeve 22 over time.

Figure 7A:
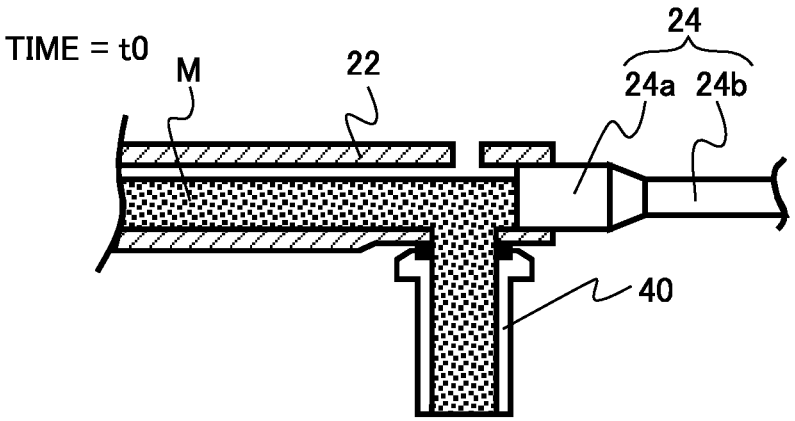
FIGS. 7A, 7B, and 7C are an explanatory diagram of an example of an operation of the die casting machine of the first embodiment.
Figure 7B:
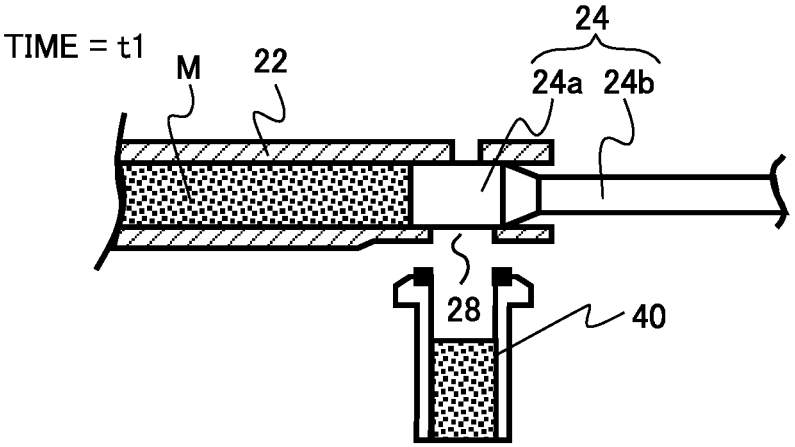
Figure 7C:
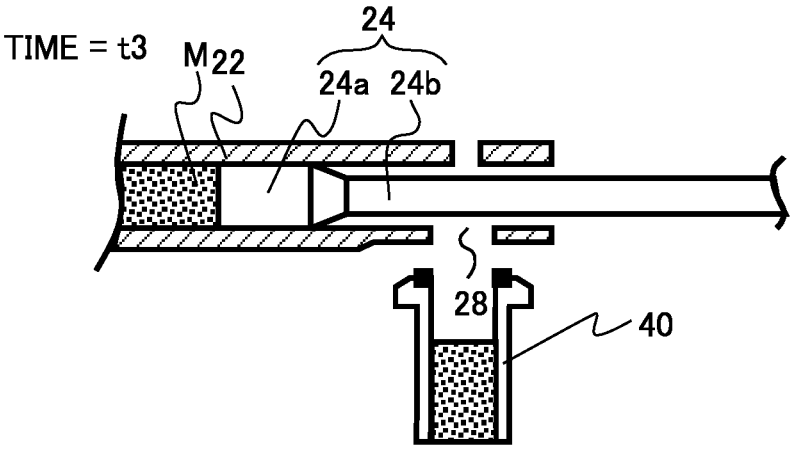

FIGS. 7A, 7B, and 7C are a schematic diagram showing a state in the sleeve 22 during the injection operation of the die casting machine 100 of the first embodiment. FIG. 7A shows a case at the time to, FIG. 7B shows a case at the time t1, and FIG. 7C shows a case at the time t3.

In Step ST1, when a predetermined molten metal supply start condition is satisfied, the supply of the molten metal into the sleeve 22 is started by the command from the molten metal supply control circuit 32*b*. Specifically, the electromagnetic pump 54 is operated to start the supply of the molten metal from the holding furnace 42 into the sleeve 22 via the molten metal supply pipe 40.

In Step ST2, the molten metal supply control circuit 32*b* determines whether or not the molten metal surface in the sleeve 22 reaches a predetermined height by the molten metal sensor 26. In the case of the negative determination, the molten metal supply control circuit 32*b* maintains the current molten metal supply speed. In the case of the positive determination, the molten metal supply control circuit 32*b* proceeds to the following Step ST3.

In Step ST3, the molten metal supply control circuit 32*b* controls the electromagnetic pump 54 so that the molten metal supply speed into the sleeve 22 decreases. It is possible to realize a desired filling rate with high accuracy by decreasing the molten metal supply speed.

In Step ST4, when a predetermined molten metal supply stop condition is satisfied, the molten metal supply control circuit 32*b* stops the supply of the molten metal from the holding furnace 42 to the sleeve 22. The molten metal supply stop condition is, for example, that the height of the molten metal surface detected by the molten metal level sensor 56 reaches a predetermined value satisfying a desired filling rate. The molten metal supply stop operation is performed by stopping the operation of the electromagnetic pump 54.

Step ST4 is a state of the time t0 of FIG. 6. Further, Step ST4 is a state of FIG. 7A. The molten metal supply control circuit 32*b* controls the electromagnetic pump 54, for example, so that the filling rate of the molten metal M into the sleeve 22 becomes 70% or more.

In Step ST5, the injection of the molten metal into the sleeve 22 starts by the command of the injection control circuit 32*c*. That is, injection drive device 25 is controlled so that the plunger 24 starts to advance. The injection speed of the plunger 24 at this time is relatively low between the time t0 and the time t1 in FIG. 6. The injection speed of the plunger 24 is, for example, less than 1 m/s.

In Step ST6, the injection control circuit 32*c* and the detachment control circuit 32*d* determine whether or not the plunger 24 reaches a position of blocking the molten metal supply port 28 from the position information detected by the position sensor 27. In the case of the negative determination, a relatively low injection speed is maintained. In the case of the positive determination, the process advances to Step ST7.

In Step ST7, the detachment control circuit 32*d* detaches the molten metal supply pipe 40 from the molten metal supply port 28. Specifically, the detachment control circuit 32*d* issues a command to the lifter 60 and moves the holding furnace 42 downward to detach the molten metal supply pipe 40 fixed to the holding furnace 42 from the molten metal supply port 28. A distance (a in FIG. 3) between the molten metal supply port 28 and the molten metal supply pipe 40 after detachment is, for example, 1 mm or more and 10 mm or less.

Step ST7 is a state of the time t1 of FIG. 6. Further, Step ST7 is a state of FIG. 7B. At this time, for example, the molten metal supply control circuit 32*b* maintains the molten metal surface position in the molten metal supply pipe 40 at a relatively high position directly below the molten metal supply port 28.

Since the molten metal supply port 28 is blocked by the plunger tip 24*a*, the molten metal M in the sleeve 22 does not leak from the molten metal supply port 28. The filling rate of the molten metal M in the sleeve 22 is, for example, 95% or more. The filling rate of the molten metal M in the sleeve 22 is, for example, 100%.

In Step ST8, the injection control circuit 32*c* increases the injection speed of the plunger 24. The injection control circuit 32*c* controls the injection drive device 25 to switch the injection speed of the plunger 24 to the high-speed injection speed VH for the high-speed injection. The injection speed of the plunger 24 is, for example, 1 m/s or more.

In Step ST9, the injection control circuit 32*c* controls the injection drive device 25 to raise and maintain the pressure of the molten metal M.

Step ST9 is a state of the time t3 of FIG. 7. Further, Step ST9 is a state of FIG. 7C. In Step ST9, the plunger 24 is stopped.

Steps ST1 to ST9 are performed every casting cycle.

Next, the function and effect of the die casting machine of the first embodiment will be described.

In the semi-hot chamber type die casting machine, the molten metal supply pipe may be broken due to an impact applied to the connection portion between the sleeve and the molten metal supply pipe during the injection of the plunger. Thus, it is desired to reduce the impact applied to the molten metal supply pipe during the injection of the plunger and suppress the breakage of the molten metal supply pipe.

The die casting machine 100 of the first embodiment includes the molten metal supply pipe 40 which is attachable to and detachable from the molten metal supply port 28 and the lifter 60 which detaches the molten metal supply pipe 40 from the molten metal supply port 28 when the plunger 24 is sliding. An impact generated by the injection of the plunger 24 is not applied to the molten metal supply pipe 40 by detaching the molten metal supply pipe 40 from the molten metal supply port 28. Thus, the breakage of the molten metal supply pipe 40 is suppressed.

The distance (a in FIG. 3) between the molten metal supply port 28 and the molten metal supply pipe 40 after the molten metal supply pipe 40 is detached from the molten metal supply port 28 is preferably 1 mm or more and 10 mm or less. It is possible to suppress the sleeve 22 from hitting the molten metal supply pipe 40 due to the impact generated by the injection of the plunger 24 by setting the distance a to 1 mm or more. Further, when the distance is set to 10 mm or less, the time required for connecting the molten metal supply port 28 and the molten metal supply pipe 40 is shortened for the subsequent casting cycle.

The molten metal surface position in the molten metal supply pipe 40 after the molten metal supply pipe 40 is detached from the molten metal supply port 28 is preferably maintained at a relative high position directly below the molten metal supply port 28. Accordingly, it is possible to shorten the time required to fill the sleeve 22 with the molten metal during the subsequent casting cycle.

The molten metal supply pipe 40 is preferably formed only of ceramics having high heat resistance. For example, when metal is used for the molten metal supply pipe 40, the molten metal supply pipe made of metal may be broken by the high-temperature molten metal. Ceramics are inferior in impact resistance to metals. However, in the die casting machine 100 of the first embodiment, since the molten metal supply pipe 40 is separated from the sleeve 22, no impact is applied to the molten metal supply pipe 40. Thus, the molten metal supply pipe 40 can be formed only of ceramics.

The ceramic molten metal supply pipe 40 preferably does not have a bent portion from the viewpoint of maintaining strength. The molten metal supply pipe 40 preferably has a cylindrical shape extending in a linear shape from the viewpoint of maintaining strength.

The die casting machine 100 of the first embodiment includes the molten metal sensor 26 and the molten metal level sensor 56. The molten metal sensor 26 can detect the molten metal surface immediately before the supply of the molten metal ends and switch the molten metal supply speed from a high speed to a low speed. Then, the molten metal level sensor 56 can measure the molten metal surface position with high accuracy. Thus, it is possible to shorten the molten metal supply time and improve the molten metal supply accuracy.

The molten metal supply control circuit 32*b* controls the electromagnetic pump 54 so that the filling rate of the molten metal in the sleeve 22 at the time point when the supply of the molten metal into the sleeve 22 is completed becomes preferably 70% or more and more preferably 80% or more. Further, the molten metal supply control circuit 32*b* controls the electromagnetic pump 54 so that the filling rate of the molten metal in the sleeve 22 when the plunger tip 24*a* reaches a position of blocking the molten metal supply port 28 becomes preferably 95% or more and more preferably 98% or more. Entrainment of gas in the molten metal is reduced, and the quality of the die casting product is improved.

Further, in the die casting machine 100 of the first embodiment, the injection control circuit 32*c* controls the injection drive device 25 so that the injection speed of the plunger 24 increases after the plunger tip 24*a* reaches a position of blocking the molten metal supply port 28. Therefore, it is possible to shorten the manufacturing time of the die casting product.

As described above, according to the first embodiment, since the molten metal supply pipe 40 which is attachable to and detachable from the molten metal supply port 28 and the lifter 60 which detaches the molten metal supply pipe 40 from the molten metal supply port 28 when the plunger 24 is sliding are provided, it is possible to realize the die casting machine capable of reducing the impact applied to the molten metal supply pipe 40 during the injection of the plunger 24 and suppressing the breakage of the molten metal supply pipe 40.

Second Embodiment

A die casting machine of a second embodiment is different from that of the first embodiment in that a molten metal supply pipe is movable relative to a holding furnace and a moving mechanism moves a molten metal supply pipe independently from the holding furnace. Hereinafter, some descriptions of the contents overlapping with the first embodiment will be omitted.

Figure 8:
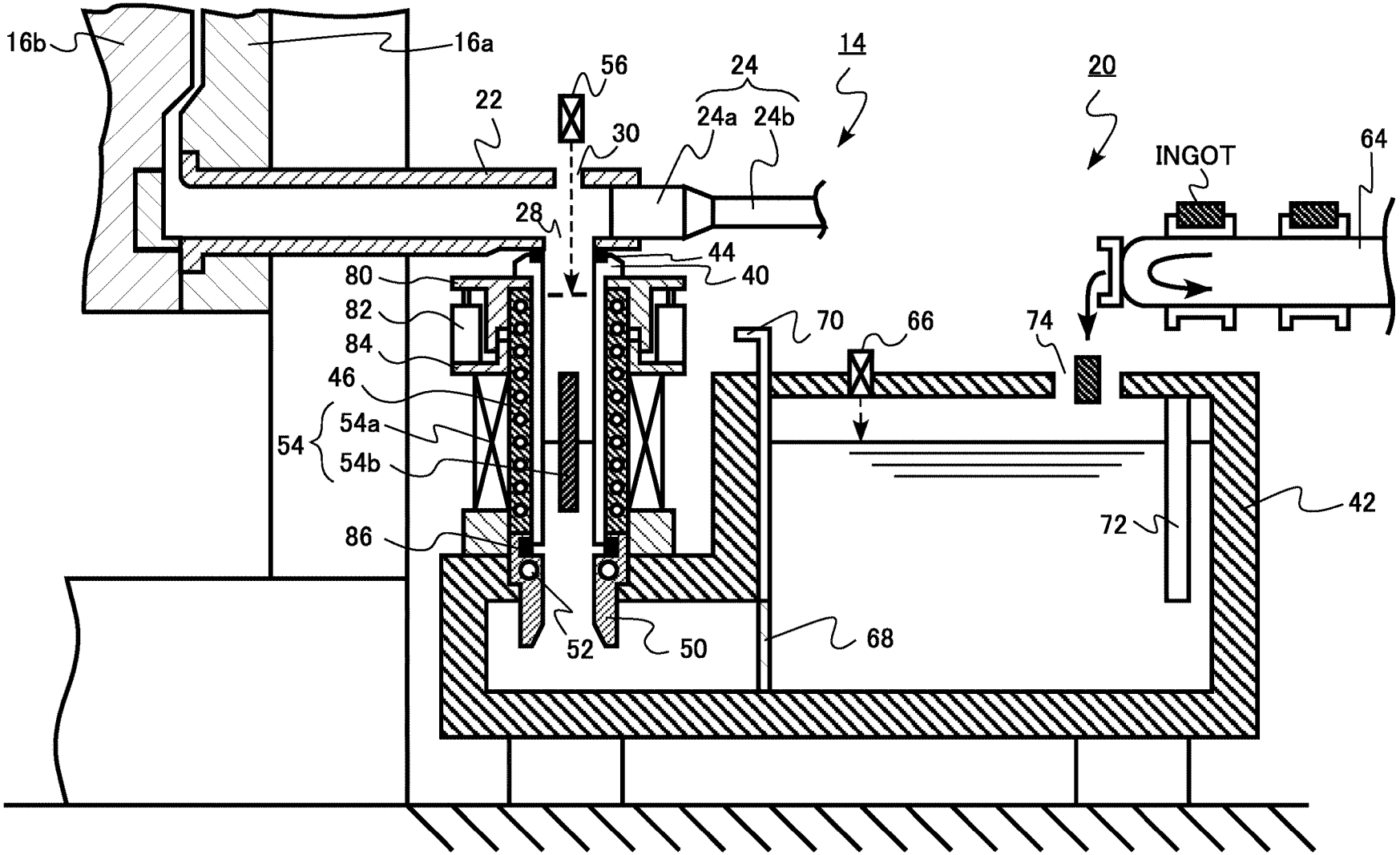
FIG. 8 is a schematic cross-sectional view showing a sleeve, a plunger, and a molten metal supply device of a die casting machine of a second embodiment.

FIG. 8 is a schematic cross-sectional view showing a sleeve, a plunger, and a molten metal supply device of the die casting machine of the second embodiment.

The die casting machine of the second embodiment is a semi-hot chamber type die casting machine.

The die casting machine of the second embodiment includes a mold clamping device 10, an extrusion device 12, an injection device 14, a mold 16, a control system 18, and a molten metal supply device 20.

The injection device 14 includes a sleeve 22, a plunger 24, an injection drive device 25, and a position sensor 27. The plunger 24 includes a plunger tip 24*a* and a plunger rod 24*b*. The sleeve 22 is provided with a molten metal sensor 26 (first sensor), a molten metal supply port 28, and a gas vent port 30.

The mold 16 includes a fixed die 16*a* and a movable die 16*b*.

The control system 18 includes a control device 32, an input device 34, and a display device 36. The control device 32 includes a molding condition setting circuit 32*a*, a molten metal supply control circuit 32*b*, an injection control circuit 32*c*, and a detachment control circuit 32*d*.

The molten metal supply device 20 includes a molten metal supply pipe 40, a holding furnace 42, a packing 44, a first heater 46, a molten metal supply pipe sleeve 50, a second heater 52, an electromagnetic pump 54 (molten metal supply drive device), a molten metal level sensor 56 (second sensor), a metal feeder 64, a molten metal supply pipe support member 80, an actuator 82 (moving mechanism), an actuator support member 84, and a slide member 86. The holding furnace 42 is provided with a holding furnace molten metal level sensor 66, a filter 68, a filter support 70, a holding furnace heater 72, and a metal supply port 74. The electromagnetic pump 54 includes a coil 54*a* and a core 54*b*.

The molten metal supply pipe 40 is provided below the sleeve 22. The molten metal supply pipe 40 is attachable to and detachable from the molten metal supply port 28 of the sleeve 22. The molten metal supply pipe 40 is relatively movable, for example, with respect to the holding furnace 42. The molten metal supply pipe 40 has a function of supplying the molten metal into the sleeve 22.

The molten metal supply pipe support member 80 has a function of supporting the molten metal supply pipe 40. The molten metal supply pipe support member 80 supports the molten metal supply pipe 40 with a fringe provided at the upper end of the molten metal supply pipe 40.

The actuator 82 is an example of the moving mechanism. The actuator 82 has a function of attaching and detaching the molten metal supply pipe 40 to and from the molten metal supply port 28 by moving the molten metal supply pipe 40 in the up and down direction. The actuator 82 has a function of detaching the molten metal supply pipe 40 from the molten metal supply port 28 when the plunger 24 is sliding.

The actuator 82 is, for example, a pneumatic cylinder. The actuator 82 may be, for example, a hydraulic cylinder or a solenoid actuator.

The actuator support member 84 supports the actuator 82.

The molten metal supply pipe 40 and the molten metal supply pipe sleeve 50 move relative to each other in the up and down direction by operating the actuator 82. Further, the molten metal supply pipe support member 80 and the actuator support member 84 move relative to each other in the up and down direction by operating the actuator 82.

In order to stably move the molten metal supply pipe 40 up and down, for example, three or more actuators 82 are provided around the molten metal supply pipe 40.

The slide member 86 is provided between the molten metal supply pipe 40 and the molten metal supply pipe sleeve 50. The slide member 86 suppresses the molten metal from leaking from a gap between the molten metal supply pipe 40 and the molten metal supply pipe sleeve 50.

The detachment control circuit 32*d* has a function of controlling the actuator 82 based on the position of the plunger 24 detected by the position sensor 27. For example, the detachment control circuit 32*d* controls the actuator 82 so that the molten metal supply pipe 40 is detached from the molten metal supply port 28 after the plunger tip 24*a* blocks the molten metal supply port 28.

As described above, according to the second embodiment, since the molten metal supply pipe 40 which is attachable to and detachable from the molten metal supply port 28 and the actuator 82 which detaches the molten metal supply pipe 40 from the molten metal supply port 28 when the plunger 24 is sliding are provided, it is possible to realize the die casting machine capable of reducing the impact applied to the molten metal supply pipe 40 during the injection of the plunger 24 and suppressing the breakage of the molten metal supply pipe 40.

Further, in the second embodiment, only the molten metal supply pipe 40 is moved up and down unlike the first embodiment. In other words, the holding furnace 42 is fixed. Thus, the second embodiment is suitable for a large die casting machine that requires a heavy holding furnace 42.

Third Embodiment

A die casting machine of a third embodiment is different from that of the first embodiment in that a molten metal supply drive device is a pneumatic device that raises an air pressure in a holding furnace. Hereinafter, some descriptions of the contents overlapping with the first embodiment will be omitted.

Figure 9:
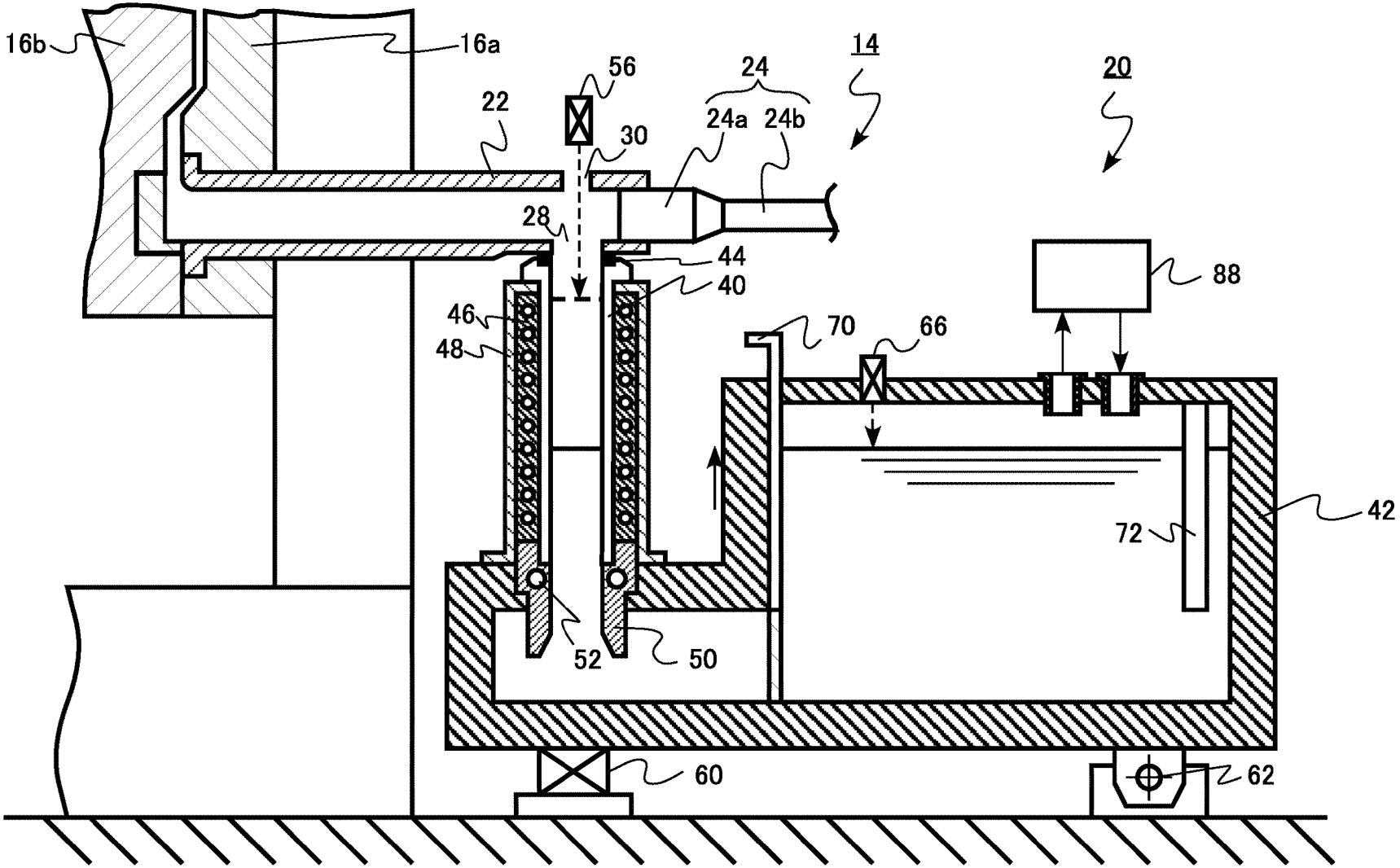
FIG. 9 is a schematic cross-sectional view showing a sleeve, a plunger, and a molten metal supply device of a die casting machine of a third embodiment.

FIG. 9 is a schematic cross-sectional view showing a sleeve, a plunger, and a molten metal supply device of the die casting machine of the third embodiment.

The die casting machine of the third embodiment is a semi-hot chamber type die casting machine.

The die casting machine of the third embodiment includes a mold clamping device 10, an extrusion device 12, an injection device 14, a mold 16, a control system 18, and a molten metal supply device 20.

The injection device 14 includes a sleeve 22, a plunger 24, an injection drive device 25, and a position sensor 27. The plunger 24 includes a plunger tip 24*a* and a plunger rod 24*b*. The sleeve 22 is provided with a molten metal sensor 26 (first sensor), a molten metal supply port 28, and a gas vent port 30.

The mold 16 includes a fixed die 16*a* and a movable die 16*b*.

The control system 18 includes a control device 32, an input device 34, and a display device 36. The control device 32 includes a molding condition setting circuit 32*a*, a molten metal supply control circuit 32*b*, an injection control circuit 32*c*, and a detachment control circuit 32*d*.

The molten metal supply device 20 includes a molten metal supply pipe 40, a holding furnace 42, a packing 44, a first heater 46, a guard member 48, a molten metal supply pipe sleeve 50, a second heater 52, a pneumatic device 88 (molten metal supply drive device), a molten metal level sensor 56 (second sensor), a lifter 60 (moving mechanism), and a fulcrum 62. The holding furnace 42 is provided with a holding furnace molten metal level sensor 66, a filter 68, a filter support 70, and a holding furnace heater 72.

The pneumatic device 88 generates a driving force for transferring the molten metal from the holding furnace 42 to the sleeve 22 via the molten metal supply pipe 40. The pneumatic device 88 pressurizes the inside of the holding furnace 42 by supplying a gas into the closed holding furnace 42. Accordingly, a pressure which is higher than an atmospheric pressure is applied to the molten metal surface in the holding furnace 42. Due to this pressure, the sleeve 22 is filled with the molten metal.

The molten metal supply control circuit 32*b* has a function of controlling the supply of the molten metal from the holding furnace 42 into the sleeve 22 based on the data of the molten metal surface position detected by the molten metal sensor 26 and the molten metal level sensor 56. The supply of the molten metal into the sleeve 22 is performed by controlling the driving of the pneumatic device 88.

As described above, according to the third embodiment, since the molten metal supply pipe 40 which is attachable to and detachable from the molten metal supply port 28 and the lifter 60 which detaches the molten metal supply pipe 40 from the molten metal supply port 28 when the plunger 24 is sliding are provided, it is possible to realize the die casting machine capable of reducing the impact applied to the molten metal supply pipe 40 during the injection of the plunger 24 and suppressing the breakage of the molten metal supply pipe 40.

Fourth Embodiment

A die casting machine of a fourth embodiment is different from that of the third embodiment in that a molten metal supply pipe is movable relative to a holding furnace and a moving mechanism moves the molten metal supply pipe independently from the holding furnace. Hereinafter, some descriptions of the contents overlapping with the first embodiment and the third embodiment will be omitted.

Figure 10:
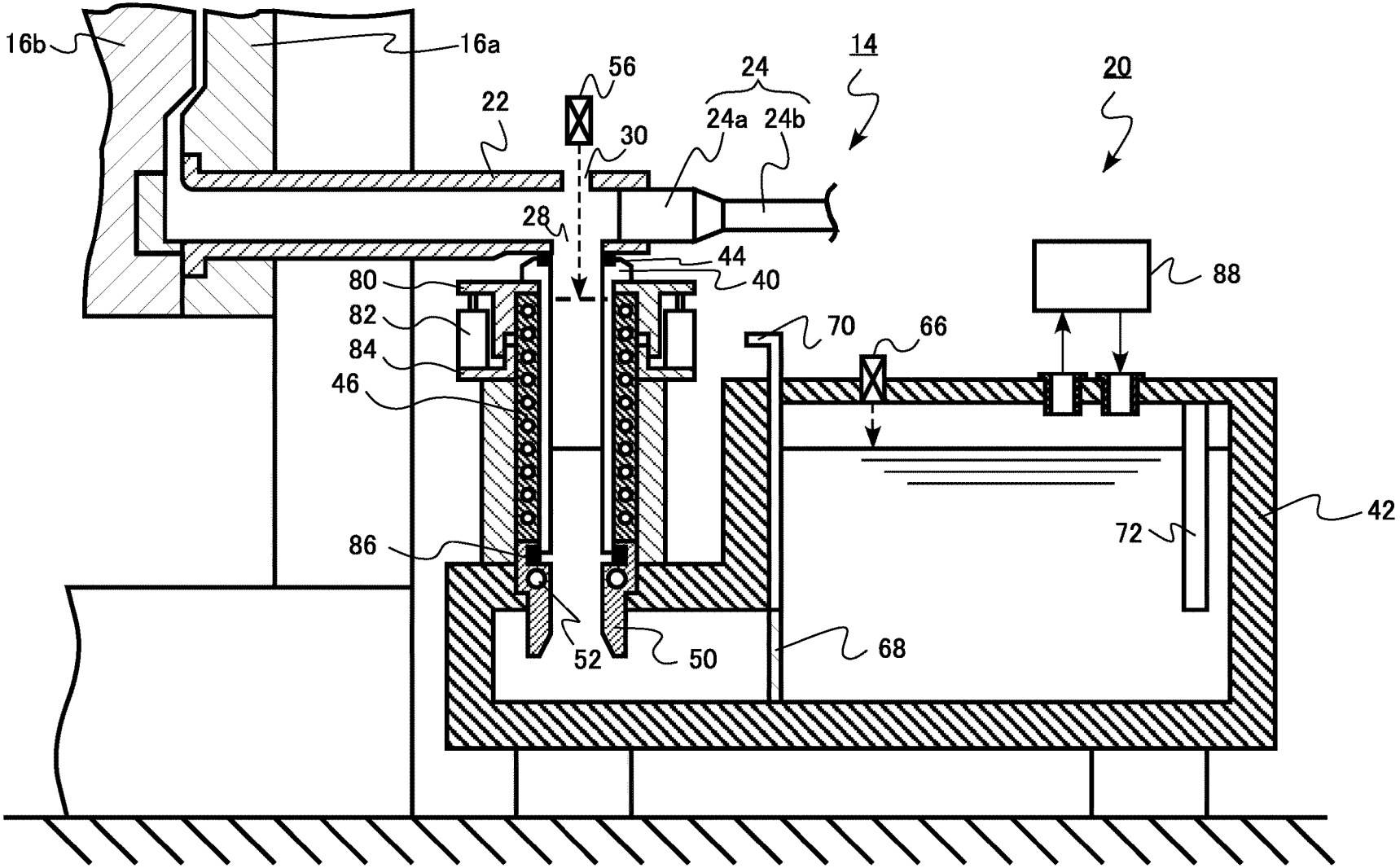
FIG. 10 is a schematic cross-sectional view showing a sleeve, a plunger, and a molten metal supply device of a die casting machine of a fourth embodiment.

FIG. 10 is a schematic cross-sectional view showing a sleeve, a plunger, and a molten metal supply device of the die casting machine of the fourth embodiment.

The die casting machine of the fourth embodiment is a semi-hot chamber type die casting machine.

The die casting machine of the fourth embodiment includes a mold clamping device 10, an extrusion device 12, an injection device 14, a mold 16, a control system 18, and a molten metal supply device 20.

The injection device 14 includes a sleeve 22, a plunger 24, an injection drive device 25, and a position sensor 27. The plunger 24 includes a plunger tip 24*a* and a plunger rod 24*b*. The sleeve 22 is provided with a molten metal sensor 26 (first sensor), a molten metal supply port 28, and a gas vent port 30.

The mold 16 includes a fixed die 16*a* and a movable die 16*b*.

The control system 18 includes a control device 32, an input device 34, and a display device 36. The control device 32 includes a molding condition setting circuit 32*a*, a molten metal supply control circuit 32*b*, an injection control circuit 32*c*, and a detachment control circuit 32*d*.

The molten metal supply device 20 includes a molten metal supply pipe 40, a holding furnace 42, a packing 44, a first heater 46, a molten metal supply pipe sleeve 50, a second heater 52, a pneumatic device 88 (molten metal supply drive device), a molten metal level sensor 56 (second sensor), a molten metal supply pipe support member 80, an actuator 82 (moving mechanism), an actuator support member 84, and a slide member 86. The holding furnace 42 is provided with a holding furnace molten metal level sensor 66, a filter 68, a filter support 70, a holding furnace heater 72, and a metal supply port 74.

The molten metal supply pipe 40 is provided below the sleeve 22. The molten metal supply pipe 40 is attachable to and detachable from the molten metal supply port 28 of the sleeve 22. For example, the molten metal supply pipe 40 is movable relative to the holding furnace 42. The molten metal supply pipe 40 has a function of supplying the molten metal into the sleeve 22.

The molten metal supply pipe support member 80 has a function of supporting the molten metal supply pipe 40. The molten metal supply pipe support member 80 supports the molten metal supply pipe 40 with a fringe provided at the upper end of the molten metal supply pipe 40.

The actuator 82 is an example of the moving mechanism. The actuator 82 has a function of attaching and detaching the molten metal supply pipe 40 to and from the molten metal supply port 28 by moving the molten metal supply pipe 40 in the up and down direction. The actuator 82 has a function of detaching the molten metal supply pipe 40 from the molten metal supply port 28 when the plunger 24 is sliding.

The actuator 82 is, for example, a pneumatic cylinder. The actuator 82 may be, for example, a hydraulic cylinder or a solenoid actuator.

The actuator support member 84 supports the actuator 82.

The molten metal supply pipe 40 and the molten metal supply pipe sleeve 50 move relative to each other in the up and down direction by operating the actuator 82. Further, the molten metal supply pipe support member 80 and the actuator support member 84 move relative to each other in the up and down direction by operating the actuator 82.

The slide member 86 is provided between the molten metal supply pipe 40 and the molten metal supply pipe sleeve 50. The slide member 86 suppresses the molten metal from leaking from a gap between the molten metal supply pipe 40 and the molten metal supply pipe sleeve 50.

The detachment control circuit 32*d* has a function of controlling the actuator 82 based on the position of the plunger 24 detected by the position sensor 27. For example, the detachment control circuit 32*d* controls the actuator 82 so that the molten metal supply pipe 40 is detached from the molten metal supply port 28 after the plunger tip 24*a* blocks the molten metal supply port 28.

As described above, according to the fourth embodiment, since the molten metal supply pipe 40 which is attachable to and detachable from the molten metal supply port 28 and the actuator 82 which detaches the molten metal supply pipe 40 from the molten metal supply port 28 when the plunger 24 is sliding are provided, it is possible to realize the die casting machine capable of reducing the impact applied to the molten metal supply pipe 40 during the injection of the plunger 24 and suppressing the breakage of the molten metal supply pipe 40.

Further, in the fourth embodiment, only the molten metal supply pipe 40 is moved up and down unlike the third embodiment. In other words, the holding furnace 42 is fixed. Thus, the fourth embodiment is suitable for a large die casting machine that requires a heavy holding furnace 42.

The embodiments of the invention have been described above with reference to specific examples. However, the invention is not limited to these specific examples. In the embodiments, the description of the part of the die casting machine or the like that is not directly required for the description of the invention is omitted, but the required elements related to the die casting machine or the like can be appropriately selected and used.

It is also possible to provide a horizontal moving means that enables horizontal movement of the holding furnace 42 below the holding furnace 42 of the first to fourth embodiments. The horizontal moving means is, for example, a vehicle wheel. The maintenance of the holding furnace 42 becomes easy by providing the horizontal moving means.

In the first or third embodiment, for example, a lifter may be provided instead of the fulcrum 62 to move the holding furnace 42 in the perpendicular direction.

In addition, all die casting machines which include the elements of the invention and which can be appropriately redesigned by those skilled in the art are included in the scope of the invention. The scope of the invention is defined by the scope of claims and the scope of their equivalents.

What is claimed is:

1. A die casting machine comprising:

a holding furnace configured to hold molten metal;

a sleeve located outside the holding furnace, the sleeve connected to an inside of a mold, and the sleeve including a molten metal supply port;

a plunger configured to slide through the sleeve and including a plunger rod and a plunger tip fixed to a tip of the plunger rod;

a molten metal supply pipe configured to supply the molten metal into the sleeve the molten metal supply pipe being attachable to and detachable from the molten metal supply port;

a moving mechanism configured to detach the molten metal supply pipe from the molten metal supply port when the plunger is sliding; and a first sensor facing a predetermined height between a lowermost portion and an uppermost portion of an inner surface of the sleeve and configured to detect that the molten metal in the sleeve reaches the predetermined height.

2. The die casting machine according to claim 1, further comprising:

an injection drive device configured to drive the plunger; and an injection control circuit configured to control the injection drive device so that an injection speed of the plunger increases after the plunger tip reaches a position of blocking the molten metal supply port.

3. The die casting machine according to claim 1, wherein a distance between the molten metal supply port and the molten metal supply pipe after the molten metal supply pipe is detached from the molten metal supply port is 1 mm or more and 10 mm or less.

4. The die casting machine according to claim 1, further comprising:

a detachment control circuit configured to control the moving mechanism so that the molten metal supply pipe is detached from the molten metal supply port after the plunger tip blocks the molten metal supply port.

5. The die casting machine according to claim 1, wherein the molten metal supply port is provided at a lower portion of the sleeve.

6. The die casting machine according to claim 1, wherein the molten metal supply pipe is fixed to the holding furnace and the moving mechanism moves the holding furnace.

7. The die casting machine according to claim 1, wherein the molten metal supply pipe is movable relative to the holding furnace and the moving mechanism moves the molten metal supply pipe independently from the holding furnace.

8. The die casting machine according to claim 1, wherein the molten metal supply pipe has a cylindrical shape extending in a linear shape.

9. The die casting machine according to claim 8, wherein the molten metal supply pipe is made of ceramics.

10. The die casting machine according to claim 1, further comprising:

a molten metal supply drive device configured to generate a driving force for transferring the molten metal from the holding furnace to the sleeve via the molten metal supply pipe.

11. The die casting machine according to claim 10, wherein the molten metal supply drive device is an electromagnetic pump.

12. The die casting machine according to claim 10, wherein the molten metal supply drive device is a pneumatic device raising an air pressure in the holding furnace.

13. The die casting machine according to claim 10, further comprising:

a molten metal supply control circuit configured to control the molten metal supply drive device so that a filling rate of the molten metal in the sleeve becomes 70% or more at a time point when a supply of the molten metal into the sleeve is completed and configured to control the molten metal supply drive device so that a filling rate of the molten metal in the sleeve becomes 95% or more when the plunger tip reaches a position of blocking the molten metal supply port.

14. A die casting machine comprising:

a holding furnace configured to hold molten metal;

a sleeve located outside the holding furnace, the sleeve connected to an inside of a mold, and the sleeve including a molten metal supply port;

a plunger configured to slide through the sleeve and including a plunger rod and a plunger tip fixed to a tip of the plunger rod;

a molten metal supply pipe configured to supply the molten metal into the sleeve the molten metal supply pipe being attachable to and detachable from the molten metal supply port; and a moving mechanism configured to detach the molten metal supply pipe from the molten metal supply port when the plunger is sliding;

wherein the sleeve includes a gas vent port provided at an upper portion, and wherein the die casting machine further comprises a second sensor provided above the gas vent port and configured to detect a molten metal surface position of the molten metal in the sleeve.

* * * * *